US006488105B1

(12) United States Patent
Wilcox

(10) Patent No.: US 6,488,105 B1
(45) Date of Patent: Dec. 3, 2002

(54) METHOD AND APPARATUS FOR SUBSURFACE EXPLORATION

(75) Inventor: Brian Wilcox, La Canada, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/477,499

(22) Filed: Jan. 4, 2000

Related U.S. Application Data

(60) Provisional application No. 60/114,851, filed on Jan. 4, 1999.

(51) Int. Cl.[7] ..... E21B 10/36; E21B 07/26

(52) U.S. Cl. ..... 175/298; 175/305; 175/19

(58) Field of Search ..... 175/19, 20, 21, 175/293, 298, 305; 405/159, 184

(56) References Cited

U.S. PATENT DOCUMENTS

| | | | | | |
|---|---|---|---|---|---|
| 3,480,092 | A | * | 11/1969 | Reinold | 175/19 |
| 3,756,328 | A | * | 9/1973 | Sudnishnikov et al. | 173/91 |
| 3,865,200 | A | * | 2/1975 | Schmidt | 175/19 |
| 3,952,813 | A | * | 4/1976 | Chepurnoi et al. | 173/91 |
| 4,974,687 | A | * | 12/1990 | Kayas | 175/19 |
| 5,311,950 | A | * | 5/1994 | Spektor | 175/19 |
| 5,377,551 | A | * | 1/1995 | Vacquer | 73/864.45 |
| 5,603,383 | A | * | 2/1997 | Wentworth et al. | 173/91 |
| 5,662,180 | A | * | 9/1997 | Coffman et al. | 175/57 |
| 5,850,884 | A | * | 12/1998 | Rodger et al. | 173/91 |
| 5,934,386 | A | * | 8/1999 | Prater et al. | 175/19 |

OTHER PUBLICATIONS

Clemmow, "The Design of Percussive Drilling Bits," Mining & Minerals Engineering, Mar., 1965, pp. 259–267.
Fairhurst, "Wave Mechanics of Percussive Drilling—Part 1," Mine & Quarry Engineering, Mar., 1961, pp. 122–130, 27, No. 3.
Fairhurst, "Wave Mechanics of Percussive Drilling—Part 2," Mine & Quarry Engineering, Apr., 1961, pp. 169–178, 27, No. 4.
Fairhurst, "Wave Mechanics of Percussive Drilling—Part 3," Mine & Quarry Engineering, Jul., 1961, pp. 327–328, 27, No. 7.
Hartman, "Basic Studies of Percussion Drilling," Mining Engineering, Jan., 1959, pp. 68–75.
Samuel, "Percussion Drilling . . . Is It a Lost Technique? A Review," Society of Petroleum Engineers, 1996, pp. 741–747.
"U.S. Military Specification MIL–S–46850D," Jun. 16, 1997, 18 pp.
"VascoMax T–200, T–250/T–300," 1985, Teledyne Vasco, pp. 2–3.

* cited by examiner

*Primary Examiner*—David Bagnell
*Assistant Examiner*—Jennifer R Dougherty
(74) *Attorney, Agent, or Firm*—Christie, Parker & Hale, LLP

(57) ABSTRACT

A subsurface explorer (SSX) for exploring beneath the terrestrial surface of planetary bodies such as the Earth, Mars, or comets. This exploration activity utilizes appropriate sensors and instrument to evaluate the composition, structure, mineralogy and possibly biology of the subsurface medium, as well as perhaps the ability to return samples of that medium back to the surface. The vehicle comprises an elongated skin or body having a front end and a rear end, with a nose piece at the front end for imparting force to composition material of the planetary body. Force is provided by a hammer mechanism to the back side of a nose piece from within the body of the vehicle. In the preferred embodiment, a motor spins an intermediate shaft having two non-uniform threads along with a hammer which engages these threads with two conical rollers. A brake assembly halts the rotation of the intermediate shaft, causing the conical roller to spin down the non-uniform thread to rapidly and efficiently convert the rotational kinetic energy of the hammer into translational energy.

12 Claims, 11 Drawing Sheets

METHOD AND APPARATUS FOR SUBSURFACE EXPLORATION

RELATED APPLICATIONS

This application is based on provisional patent application serial No. 60/114,851 filed Jan. 4, 1999.

GOVERNMENT LICENSE RIGHTS

The U.S. Government has certain rights in this invention pursuant to NAS7-1407 awarded by NASA.

BACKGROUND OF THE INVENTION

1. Field of the Invention

The invention is a subsurface explorer (SSX) for exploring beneath the surface of the terrestrial surface of planetary bodies such as the Earth, Mars, or comets.

2. Description of the Prior Art and Related Information

Conventional drilling requires that material be excavated entirely out of a hole, that the hole usually be lined to prevent collapse, and that power be transmitted to the excavation site from the surface by means of a relatively heavy mechanical linkage. The mass (and to a large degree the power and cost) of conventional systems grow proportionally to the desired depth of penetration since heavy mechanical components are distributed along the length of the excavated hole.

Excavation of compacted subsurface material requires energy. While the amount of energy needed to excavate a given volume of subsurface material varies considerably depending on the specific mineral and morphological structure of the medium, as well as the means for excavation, the specific energy requirements for conventional rotary drilling of medium strength rock is about 200 megajoules per cubic meter ($Mj/m^3$). Typical modem rotary drilling equipment is just capable of operating with this level of performance.

Thus, there is a need for a simple, subsurface exploring system and method which requires less energy and support than conventional drilling.

SUMMARY OF THE INVENTION

The invention is a subsurface explorer (SSX) for exploring beneath the surface of the terrestrial surface of planetary bodies such as the Earth, Mars, moons or comets. The explorer may carry appropriate sensors and instruments to evaluate the composition, structure, mineralogy and possible biology of the subsurface medium, as well as perhaps returning samples of that medium back to the surface. The exploration capability of the SSX enables scientific research and resource exploration which may not be possible or may be prohibitively expensive by alternative means such as conventional drilling.

The SSX is a relatively small robotic vehicle capable of penetrating underground, through soil, rock, or mixtures thereof, to depths many times deeper than would be possible using conventional drilling techniques of comparable mass and power. This is possible because the vehicle excavates material ahead of it's travel, moves it only a short distance to the rear of the vehicle, and recompacts it behind the vehicle. The excavated and recompacted material may also be called "overburden." Unlike prior art systems, with the present invention, the vehicle itself is compact and essentially self-contained, with power delivered to it over a fine tether which is paid out from the vehicle and becomes embedded in the recompacted medium behind the vehicle as it progresses.

One of the oldest techniques for excavation of compacted soil and rock is percussion, or hammering. Hammering of rock causes a network of fine cracks to form ahead of the hammer in zones where the compressive strength of the material is exceeded. These cracks interlock under repeated blows to ultimately create from the rock a collection of particles. In the absence of any active mechanism to remove the particles, they are ground into a fine powder. This powder can flow in a fashion similar to a fluid around the SSX as it advances, especially under the extreme acoustic excitation of the hammering action. Thus a simple, perhaps the simplest, mechanism for excavating the subsurface medium is to have an internal hammer mechanism in the SSX. In short, the SSX can be a self-contained pile driver.

The hammer mechanism of the SSX is preferably contained within the body of the SSX, which should be sealed against intrusion of dust generated by the percussive action. It should have a free volume in which to accelerate the hammer. Thus, the front end of the vehicle should not be the hammer mechanism itself, but instead may be an intermediate material which seals the front of an acceleration volume and transmits the percussive shock from the hammer to the surrounding medium. This front portion can be called a "chisel," also referred to herein as a nose piece. The hammer impacts the chisel, which in turn imparts forces on the medium which are large compared to the compressive strength of the terrain material. The momentum of the hammer is conserved with the hammer-chisel assembly, depending somewhat on the amount of rebound in the hammer from the chisel. In the case of zero rebound, the final kinetic energy of the hammer-chisel assembly is equal to the initial kinetic energy of the hammer times the ratio of the hammer mass to the combined hammer-chisel mass. This ratio becomes adverse if the chisel becomes massive. To achieve good energy transfer from the hammer to the chisel, the hammer should be made as massive as possible, and the nose and shell should be as light as possible.

The hammer mechanism may comprise a hammer portion, used as a flywheel, rotated to high surface speeds. A non-uniform pitch thread on an intermediate shaft is used to convert the rotational motion to linear motion for the hammer portion, which in turn imparts force to a nose piece which pommels the material in front of the nose piece, causing vibrational exitation of the material thereby fracturing the material.

DETAILED DESCRIPTION OF A PREFERRED EMBODIMENTS

Figure 1A:
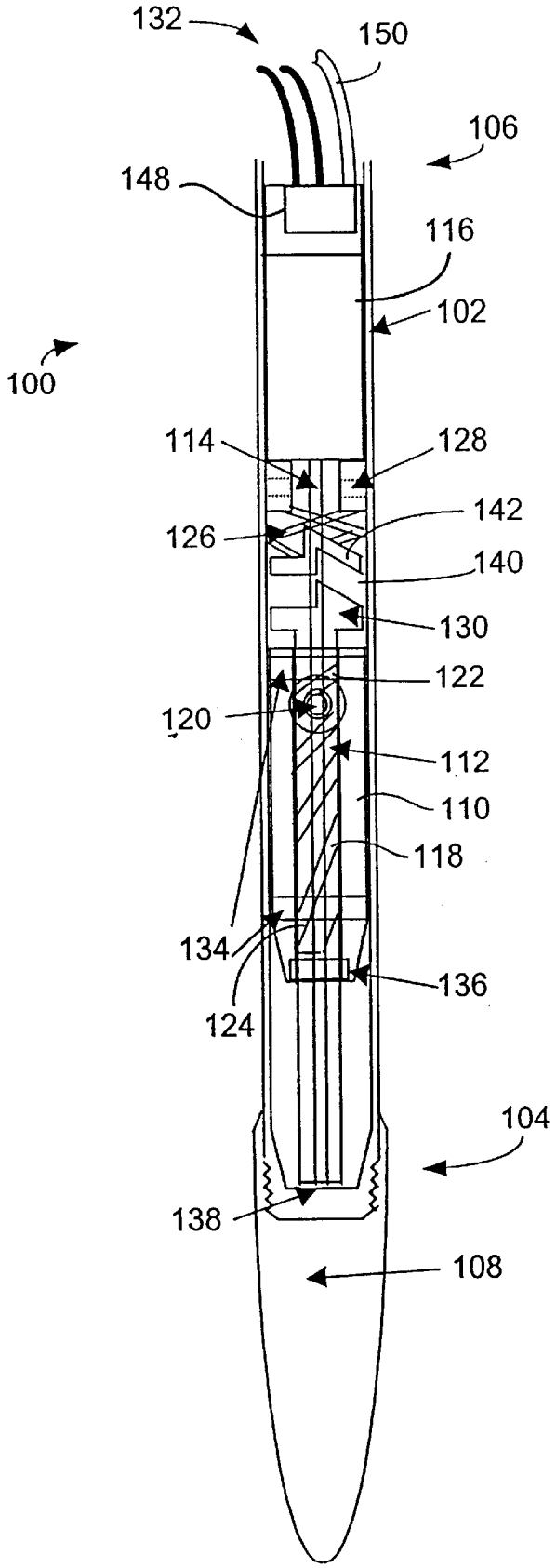
FIG. 1*a* is a somewhat diagrammatic cross-sectional view illustrating parts of the forward portion of a subsurface explorer constructed according to one embodiment of the present invention.

With reference to FIG. 1*a*, a sub-surface exploring (SSX) vehicle 100 for exploring beneath a planetary terrain is shown, the planetary terrain having a surface, and the terrain comprising composition material. The vehicle 100 has a skin or body 102 extending from a front end 104 to a rear end 106. The body may have a tapering and tether exit ports that would normally terminate at the rear of the assembly(not shown). The body 102 of the SSX 100 may be gun-drilled and honed on the inside to accommodate the inside mechanics and is preferably elongated.

The vehicle 100 may include a nose piece 108 disposed at the front end 104 to impart force on the terrain and thereby cause the vehicle 100 to fracture and penetrate the composition material in front of the nose piece 108. The force imparted by the nose piece 108 is percussive in nature and tends to pulverize the composition material to a fine powder after repeated blows. The nose piece 108 comprises a cone-shaped (or ogive) nose connected to the body 102, the cross-sectional area of the nose piece 108 exceeding that of the body 102 to create a gap between the side wall of the body 102 and the surrounding composition material during operation. As the vehicle 100 proceeds through the terrain, the pulverized material is forced backward along this gap and deposited behind the rear end 106. The nose piece 108 is preferably removable to allow selection of nose pieces 108 of different materials and dimensions for particular composition materials.

In the illustrated embodiment, the vehicle 100 has a hammer mechanism contained within the body 102 for imparting percussive force to the nose piece 108. The hammer mechanism includes a motor (e.g. an electric motor) 116 for spinning an intermediate shaft 112 having a variable pitch thread 118 and thereby rotating a hammer portion 110. The hammer mechanism further comprises a braking mechanism 140 for stopping rotation of the intermediate shaft, allowing the hammer portion to continue to rotate down the thread to impart force on the nose piece 108. The hammer mechanism is sealed against intrusion of composition material by the nose piece 108 and is spring mounted inside the vehicle 100.

The hammer mechanism, or apparatus, imparts force to the nose piece 108 for the purpose of fracturing composition material in front of the nose piece 108. The hammer mechanism comprises a hammer portion 110 capable of rotation. The hammer apparatus further comprises a translational portion for converting the rotating motion into translational motion. The translational portion may comprise the intermediate shaft 112 that is splined on the inside to engage and rotate with a motor shaft or inner splined shaft 114, or a drive shaft that motor 116 rotates. The intermediate shaft 112 may be cut with one or more variable-pitch threads 118 on the outside of the intermediate shaft 112 so that one or more conical rollers 120 attached to the hammer portion 110 may smoothly accelerate hammer portion 110 axially. The acceleration could be in the over >3:1 speed range. The electric motor 116 is preferably adopted to operate on high voltage to keep resistive losses low.

The intermediate shaft 112 comprises a shaft having a top end and a bottom end, the top end connected to the inner splined shaft 114 of the electric motor such that the intermediate shaft 112 turns with the inner splined shaft 114.

The hammer portion 110 comprises an annular hammer component defining a central opening receiving the intermediate shaft 112 for movement therealong. Outer bearings (e.g. ball bearings) 134 allow the hammer portion 110 to spin at a high speed (which may be approximately 10–20 KRPM or more) inside a honed bore of the body 102 and to slide (e.g. on bronze sleeves, not shown) along the inner bore of the body 102. Alternatively, the lower end of the intermediate shaft may be supported by bearings, eliminating the need for the outer bearing 134 on the hammer.

The threads 118 extend along the outside surface of the intermediate shaft 112. The threads 118 have a starting point 122 and an ending point 124. The starting point 112 is located adjacent to the top end of the intermediate shaft 110, and the ending point 124 is located adjacent the bottom end.

The conical rollers 120 protrude from the interior of the hammer portion 110, such that the thread 118 guides the conical rollers 120, and thereby the hammer portion 110 for axial movement. The conical roller 120 engages the starting point 122 of the thread 118, and thereby the intermediate shaft 112, causing the hammer portion 110 to be rotated as well. The kinetic energy of the hammer portion 110 is released when the rate of rotation of the intermediate shaft 112 is reduced (preferably to zero) by a braking mechanism comprising a spring 126, a mechanical stop 128, and a ratchet 140. When this occurs, the stationary thread 118 accelerates the hammer portion 110 axially by means of the conical roller 120 traversing the thread 118 causing the hammer portion 110 to impart percussive force to the nose piece 108.

An inner bearing 136 centers the intermediate shaft 112, and allows vibration-free motion of the hammer portion 110 on the intermediate shaft 112 and the inner splined shaft 114. The thread 118 ends above the free stroke of the lower ball bearing 136 so that the lower ball bearing 136 rotates and slides (e.g. also with a bronze sleeve) on the non-threaded surface of the intermediate shaft 112.

Because the thread 118, has a non-uniform pitch, comprising a low pitch near the starting point 122 of the thread and a high pitch near the ending point 124 of the thread, the forces on the hammer and the conical roller bearings can be maintained roughly constant during the hammer acceleration event.

The electric motor 116 also acts to rotate the inner splined shaft 114 in the opposite direction of rotation for causing the hammer portion 110 to return from the bottom position 124 to the top position 122. When the intermediate shaft 112 is rotated in this reverse direction, the conical roller 120 engages the ending point 124 of the thread 118 such that when the intermediate shaft 112 is spun in the reverse direction, the hammer portion 110 is spun in the reverse direction. When electric motor 116 is stopped when ratchet 140 is actuated, forces are transmitted to stop the intermediate shaft 112, while rotational kinetic energy continues for the hammer portion 110. Thus the thread 118 causes the hammer portion 110 to accelerate axially, again, by means of the conical roller 120, the conical roller traversing the thread 118, this time, from the ending point 124 back to the starting point 122.

At the point of impact 138 of the hammer portion 110 on the back of the nose piece 108, a small amount of oil can be injected with each blow of the hammer portion 110 and thereafter circulated up the inner splined shaft 114 to lubricate all moving parts.

Because of energy requirements, it may not be desirable to drill a significant distance into the composition material by relying solely on internally-stored chemical energy, since a tank of chemical fuel provides enough energy to excavate only a small fixed multiple of the vehicle's own volume into the terrain. Thus it is preferable that energy be provided from an external source. Power is provided for significant distances (on the order of kilometers) by use of a high-voltage electrical 2-wire circuit or tether wire 132. Mass or volume optimization of this power subsystem is based on the resistivity of the conductor (e.g. copper) and the dielectric breakdown strength of the insulator (e.g. Teflon) which is easily computed. Useful amounts of power (order of 100 Watts) can be delivered to significant depths (Km) using existing total tether volumes (about 1 liter), voltages of several hundred Volts, and acceptable tether power losses (~20%). The performance of the tether 132 can be increased significantly if the two conductors are paid out as far apart from each other as possible at the rear end 106 of the vehicle 100, so that the dielectric isolation of the terrain increases the breakdown voltage of the system. This is especially useful in environments where there is no liquid water; e.g. permafrost or anhydrous terrain.

Modulation of the electric current flowing through the tether 132 can also provide data transmission from the SSX 100 to the surface and vise versa in the same way that a modem can transmit information over a two-wire telephone circuit which also powers a telephone. Alternative techniques of delivering power from the surface by hydraulic, pneumatic, or chemical fuels yield the conclusion that electrical power is best, although there are some chemical fuel combinations which can be competitive if delivered through a fine capillary tether 132. Fine capillaries can can be used to return samples of the composition material to the surface for analysis. This reduces the need to miniaturize instruments so that they can be contained within the SSX 100 itself, and also reduces the power requirements of the SSX 100. For example, two capillaries 132 can be used to deliver a working fluid down one capillary and back up the other, carrying microscopic particles of the terrain medium upwards as part of the flow, or a single capillary can be used to alternately fill and flush a chamber in SSX 100 so as to bring small samples back to the surface. One possibility is to intentionally insert small spheres or other obstructions in the flow which nearly blocks the capillary 132, sweeping anything ahead of them as they move. The pressure buildup behind these spheres then pushes the sample particles along against possible adhesion to the capillary walls.

It is possible to optimize the entire SSX 100 system based on the assumed specific energy requirement needed to excavate the subsurface medium, as well as the assumed frictional coefficient and overburden pressure which bears on the sides of the vehicle 100 as it slides forward. The total energy required to penetrate to a desired depth is the sum of the excavation energy and the friction energy (after losses are accounted for). The excavation energy is proportional to the total volume excavated, which is the product of the total depth times the frontal cross-sectional area of the SSX 100. The friction energy is proportional to the sidewall friction force times the total depth. The sidewall friction is proportional to the total sidewall area, the frictional coefficient between the exterior of the SSX 100 and the subsurface medium, and the pressure which builds up between the SSX 100 and it's surroundings. This pressure, which grows as necessary to recompact the excavated medium into the hole behind the SSX 100, can become quite large. Fortunately, the vast experience obtained in the petroleum drilling industry is that this pressure never rises much above the overburden pressure (i.e. the integrated weight per unit horizontal area of the terrain above the SSX). Since the overburden pressure grows at about 30 kPa/m (assuming a composition material density of 3 g/cc), the maximum pressure at depths of 1 Km is about 30 MPa. With a frictional coefficient of about 0.3, this means that the frictional energy required to advance one meter is about 10 kJ/m per square meter of sidewall cross-section. With a specific energy for excavation of 200 Mj per cubic meter, the energy required for excavation to advance one meter is 200 Mj per square meter of frontal area. Thus, at 1 km depth, the system can afford 20 times as much sidewall area as frontal area before the frictional area dominates. For a circular cross-section, the perimeter is $\pi$ times the diameter, and the frontal area is $\pi/4$ of the diameter squared, so a sidewall area to frontal area of N implies that the length to diameter ratio should be N/4. Thus for N=20 (a depth of 1 Km) the ideal aspect ratio at that point is 5. However, since the overburden pressure rises linearly with depth, then the total energy lost to friction rises with the integral of the overburden pressure, or quadratically with depth. Meanwhile the total energy lost to excavation rises linearly with depth. Unless the aspect ratio changes with depth, the optimum average aspect ratio is greater than that which would be optimal at the maximum depth. For a maximum depth of 1 Km in medium-strength rock with a density of 3 g/cc, the ideal ratio of vehicle length to diameter is 8. For a maximum depth of 100 meters in the same rock, the ideal aspect ratio would be 80.

The SSX 100 should preferably be long and slender near the surface. As it descends, and tether 132 is paid out from inside the vehicle 100, the length of the SSX 100 should be reduced if sidewall friction is to be kept under control. Thus packages of tether 132 should periodically be jettisoned from the vehicle 100 as the tether is spent, reducing the length of the vehicle.

Since SSX 100 is self-contained and is, thus, not a useful candidate for servicing, it is desirable to minimize the mechanical complexity of the excavation device, even if this results in a modest increase in the specific energy requirements for excavation.

The tether 132 trickles the energy to the SSX 100 almost continuously. In bursts, the resistive losses of the tether would dominate over the useful energy delivered to the SSX 100. The vehicle 100 uses a brief burst of power delivered to the percussion hammer 110 in a very short period of time. Thus an energy storage and conversion mechanism may be used to store the trickled electrical energy and deliver it in a burst to the hammer mechanism.

For example, a strong man can swing a sledgehammer with a mass of 5 Kg to a kinetic energy of about 500 joules, which is sufficient to break rock at reasonable rates. If the system delivers an average of 50 Watts to the SSX 100 from the surface, then the system may get 500 joule hammer blows at a rate approaching 1 per 10 seconds. If it takes 200 $Mj/m^3$ to excavate the material, and if the system is to have an advance rate of or 0.4 mm/sec (about 1.3 meters per hour), then the frontal cross-section of the SSX is 12 $cm^2$. This corresponds to a diameter of about 4 cm, which is not too different from the diameter of the face of the 5 Kg sledgehammer.

The nose piece 108 is the material which in fact excavates the terrain medium, and is thus subject to the extreme shock and abrasion of the terrain material. It should be extremely hard to avoid rapid rates of wear, and yet, due especially to the strong possibility of quartz and other hard minerals in the terrain, it is expected to wear at some rate. To achieve depths of order 1 Km, considerable sacrificial material is incorporated into the nose piece 108. A corollary to this is that the initial shape of the nose piece 108 is almost irrelevant to the performance of the device since the sacrificial material will wear away into a natural blunt shape which depends only on the relative mechanical properties of the nose piece 108 material and the terrain material and, in the long term, is almost independent of the initial shape of the nose piece 108. Thus it is not particularly important to spend excessive effort on optimizing the frontal shape of a deep-penetrating SSX 100. It is desirable to have the cross-section of the nose piece 108 slightly larger than that of the body 102 of the SSX 100, so that the sidewall friction on the main body 102 is reduced by allowing the terrain material to relax slightly and hold itself open somewhat with its own compressional hoop strength after the nose piece 108 passes. This also reduces the sidewall friction and wear on the sidewall of the SSX 100, allowing the wall thickness of the body 102 to be reduced, which has a strong effect on the mass of the vehicle 100. Another advantage of this shape is that small vanes at the rear of the SSX 100 could push against the interior of the hole created by the vehicle 100 to slightly offset the rear of the SSX 100 in the hole or the entire vehicle 100 can be hinged at or near the centerpoint to allow it to be "bent" by a steering actuator, providing some directional control to the impact of the hammer mechanism, allowing steering of the vehicle 100.

Hazard avoidance (e.g. avoiding large rocks mixed with soil) would be accomplished by using an array of geophones at the surface (and possibly one in the SSX 100) to listen to the echo of the percussive blows of the hammer device and thus to locate the SSX 100 and to map the subsurface environment. The depth of the vehicle 100 can be determined by measuring the amount of tether 132 paid out from inside the vehicle, and the approximate direction with respect to vertical can be inferred by the motion of a spring mounted inertial mass or other acceleration sensor within the SSX 100 itself. One control loop function is to adjust the amount of hammer 110 energy imparted in each blow, especially near the surface. If the sidewall friction is not adequate to prevent the entire SSX body 102 from moving backwards as the vehicle 100 is accelerated forwards, then the hammer 110 may make zero or negative net advancement on each hammer blow. The control system measures the motion of the vehicle 100 during both the acceleration and deceleration of the hammer portion 110 to determine if the vehicle 100 is moving. Rather than double-integrating the signal from an accelerometer, which would produce a very noisy measurement, it is better to have a spring mounted inertial mass with a position encoder which can directly measure the stroke distance of the SSX body 102 on both the acceleration and deceleration portions of the hammer portion 110 cycle. The static position of the mass during the windup of the hammer portion 110 would give a measure of the vertical vector. In addition, it is desirable to have rotational sensors also on this mass so that any rotational movement induced by a hammer blow is measured. On Earth, it would be possible to have a magnetic compass to give heading, but on some planetary missions (or Earth polar missions) there is either no magnetic field or it is ambiguous. Thus the rotation sensor can give an estimate of direction, which is augmented over the long term by the acoustic/seismic sensing array.

An additional novel feature of the system is that all elements of the vehicle 100 other than the nose piece 108 and exterior of the body 102 can and should be spring mounted inside the body 102. The vehicle 100 will advance by some amount with each hammer portion 110 blow, but this distance may be short. This short stroke means that the interior components can be nearly totally shock isolated from the nose piece 108 and body 102. The shock isolation of the interior elements of the vehicle 100 from the piece 108 has two advantages: it improves the transfer of kinetic energy from the hammer portion 110 to the nose piece 108 assembly and it protects all internal components from the extreme shock of the impact event between hammer 110 and nosepiece 108.

Alternative means of solenoids, mechanically compressed gases (with and without a phase change), heat engines (i.e. using a solid or semi-solid hammer instead of the rotating portion 110 as the piston in a Stirling engine), and chemical explosions (e.g. electrolysis of water into hydrogen and oxygen) have been analyzed. All have been found wanting, since the overall conversion efficiency of the electric power into the kinetic energy of the hammer mechanism is well under 40% (and in some cases under 20%). However, a novel mechanical approach using a conventional electric motor 102 is described herein which will achieve as much as about 80% efficiency.

As in the prior example, the system may have 500 joules of energy in the combined hammer 110-nose piece 108 system. If the hammer 110 and the nose piece 108 are equally massive, then the initial energy of the hammer mechanism should be 1000 joules at the time of impact with the nose piece 108. The length to diameter aspect ratio of the SSX 100 has been deduced to be around 30–50, and with 50 watts of effective power (after the rotating portion-nose piece 108 impact, implying 100 Watts of average mechanical energy delivered by the hammering mechanism action) vehicle 100 diameters of 4 cm can be supported. With an aspect ratio of 30, the length of the vehicle 100 is 1.2 meters.

The nose piece 108 of the vehicle 100, as noted above, has sacrificial material which wears away as the vehicle 100 goes deeper, and thus might be expected to have a length of perhaps 10 cm of this total length. The body 102 similarly is a hard and tough material to withstand the abrasion of the sidewall friction. If tough steels are used for these applications, and the thickness of the body 102 shell is 15% of the radius of the cylindrical vehicle 100, then the mass of the nose piece 108 is about 1.1 Kg and the mass of the body 102 is about 3.2 Kg. The total vehicle 100 assembly is then 4.3 Kg. If the vehicle 100 diameter (sliding within the body 102 shell) is 3.4 cm, and it can be fabricated out of an extremely dense and hard material such as tungsten (density 19 gm/cc), then to get a vehicle 100 mass equal to the nose piece 108 mass requires a vehicle 100 with a length of 25 cm. It may be difficult to accelerate the hammer portion 110 to the necessary speeds in much less than its own length, so another 25 cm can be allocated for hammer portion 110 acceleration space. In practice the conservation of momentum is too simplistic an analysis to fully evaluate the relative mass of the hammer 110 and the nose piece 108; actually, a shock wave propagates from the impact point of the hammer 110 through the nose piece 108, making excess mass of nose piece 108 less objectionable than the conservative momentum conservation analysis shows.

The velocity which the hammer portion 110 should achieve to have 1000 joules of kinetic energy with a mass of 4.3 Kg is 22 meters per second. The uniform acceleration which may be needed to achieve this velocity in a distance of 25 cm is 930 $m/s^2$, or 93 g's. The force which may be needed to achieve this acceleration is 4000 Newtons. The total duration of the hammer portion 110 stroke is about 24 msec. Since 1000 joules of energy are delivered to the nose piece in 24 msec, the rate of power conversion into linear kinetic energy is 40 kilowatts. This large rate of power conversion is the principal problem that was solved for the practical implementation of the SSX 100 by the novel approach here described.

The underlying concept of the hammer portion 110 for the subsurface explorer 100 is to use the hammer portion 110 as a flywheel to store mechanical energy from the electric motor 116, and then use a simple but novel mechanism to convert the rotational kinetic energy of the hammer portion 110 into translational kinetic energy. That the hammer portion 110 can store the necessary energy when used as a flywheel is clear from computing the hoop stresses on a spinning cylinder. As described above, the hammer portion 110 should achieve a speed of about 22 meters per second prior to impact with the nose piece 108, and thus the required energy can be stored in the hammer portion 110 when the hoop velocity at the radius of gyration is the same value. The radius of gyration of a uniform cylinder is about 0.7 of its geometric radius. Thus the hoop velocity of the rim should be at least 31 m/s. The hoop stress in a spinning cylinder is the density times the square of the rim speed. Assuming that the hammer portion 110 material is tungsten, the hoop stress in the hammer portion 110 is about 18 MPa. Fortunately, tungsten is not only an extremely dense material (which is used to make the hammer portion 110 relatively massive compared to the nose piece 108 and body 102 shell), but it is also an extremely strong material, with a tensile strength of about 4 GPa. Thus the required hoop stresses in the hammer portion 110 are easily supported by the material with large factors of safety. The brittleness of tungsten can be accomodated with a steel jacket around the hammer 110 for applications where the fatigue limit is reached.

Figure 1B:
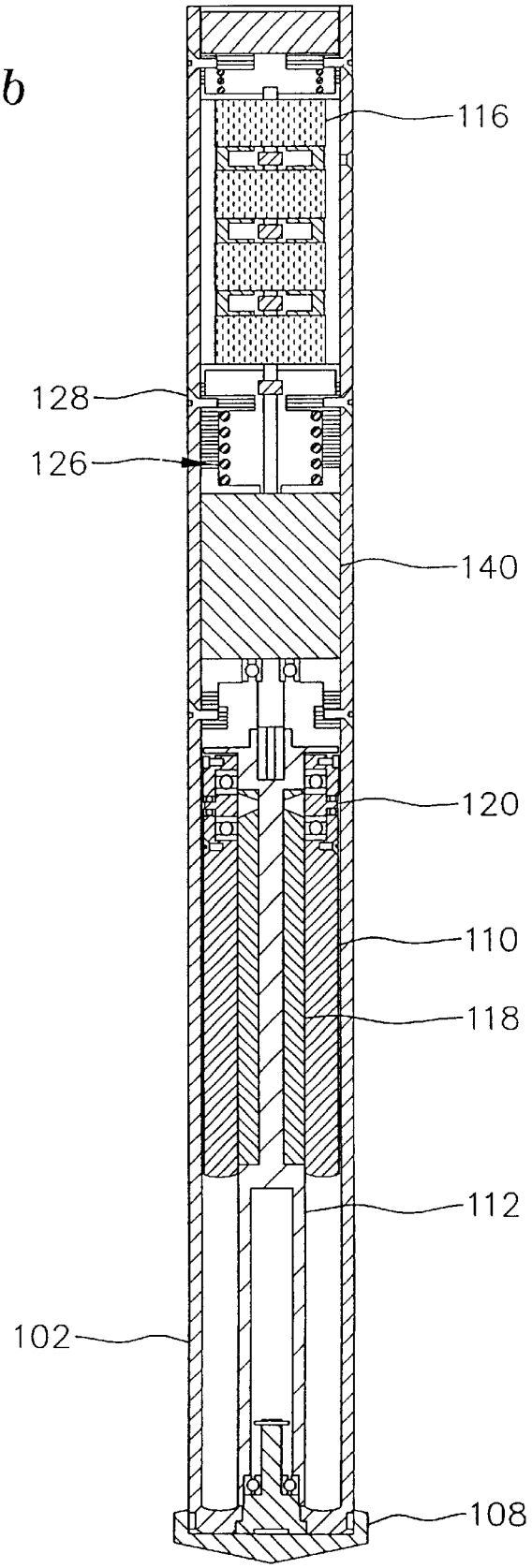
FIG. 1*b* is a somewhat diagrammatic cross-sectional view illustrating parts of the forward portion of a subsurface explorer constructed according to another embodiment of the present invention with the lateral dimension exaggerated for clarity.

The vehicle of FIG. 1*a* may further comprise a tether system 148 for spooling one or more means for providing power and communication to the vehicle 100 and returning samples to the subsurface. The tether system 148 may include a spool for spooling two or more electrical conductors 132 leading from a point of origin to the vehicle 100. The spool may also provide spooling for one or more capillary tubes 150 for moving fluids from the point of origin to the vehicle 100. The electrical conductors 132 and the capillary tubes 150 are spooled out from within the vehicle 100 and packed into the composition material deposited behind the rear end 106. With reference to FIG. 1*b*, a somewhat diagrammatic cross-sectional view illustrating parts of the forward portion of a subsurface explorer constructed according to another embodiment of the present invention is shown with the lateral dimension exaggerated for clarity. As with the embodiment shown in FIG. 1*a*, detail of the hammer mechanism for imparting force to the nose piece 108 on the front of the body 102 of a vehicle 100 is shown. The hammer mechanism shown includes a motor 116, intermediate shaft 112, hammer portion 110 and a braking mechanism 140 for stopping rotation of the intermediate shaft 112. As with the embodiment of FIG. 1*a*, the kinetic energy of the rotating hammer portion 110 is released when the rate of rotation of the intermediate shaft 112 is reduced (preferably to zero) by a braking mechanism comprising a spring 126, a mechanical stop 128, and a ratchet 140.

As with the embodiment of FIG. 1*a*, the vehicle 100 comprises a translational portion for converting the rotating motion of the hammer portion 110 into translational motion. The translational portion may comprise the intermediate shaft 112 that is splined on the inside to engage and rotate with a motor shaft or inner splined shaft 114, or a drive shaft that motor 116 rotates. The intermediate shaft 112 may be cut with one or more variable-pitch threads 118 (detail not shown in FIG. 1*b*) on the outside of the intermediate shaft 112 that engages one or more conical rollers 120 attached to the hammer portion 110 to smoothly accelerate hammer portion 110 axially.

Figure 2A:
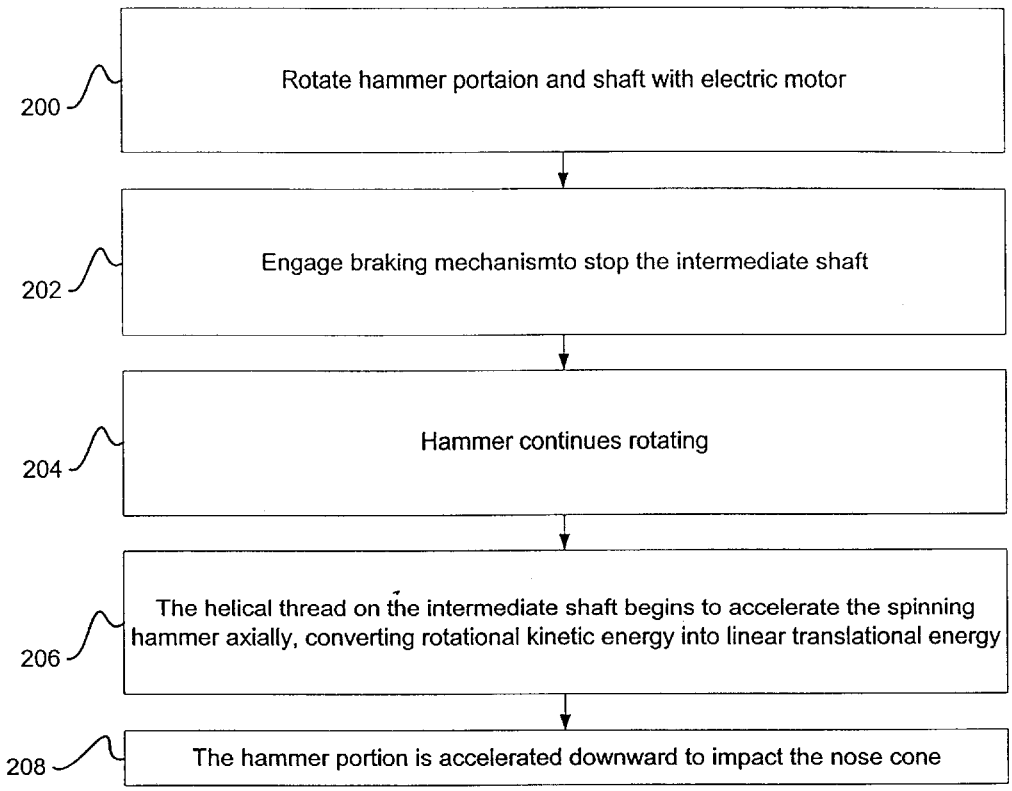
FIG. 2*a* is a flow diagram illustrating a method performed by the system of FIGS. 1*a*–1*b* for imparting percussive force to the subsurface medium, hereafter called the composition material, of a planetary body.

With reference to FIG. 2*a*, a flow diagram illustrating a method performed by the system of the present invention is shown for imparting force on a composition material. The hammer portion 110 is rotated with an electric motor 116 on an intermediate shaft 112 which has a helical thread 112 which engages conical rollers 120 protruding from the interior of the annular rotating portion 110, step 200. Once the hammer portion 110 is spun to the desired kinetic energy, the electric motor 116 is stopped by the braking mechanism 128, or by shorting, loading, or reverse-biasing the windings of the electric motor 116, step 202 or by actuating brake 140 with a solenoid. This braking action causes the rotating hammer portion 116 to continue to rotate with respect to the intermediate shaft 116, step 204. The helical thread 118 on the intermediate shaft begins to accelerate the spinning hammer 110 axially, converting rotational kinetic energy into linear, or translational, kinetic energy, step 206.

Figure 3:
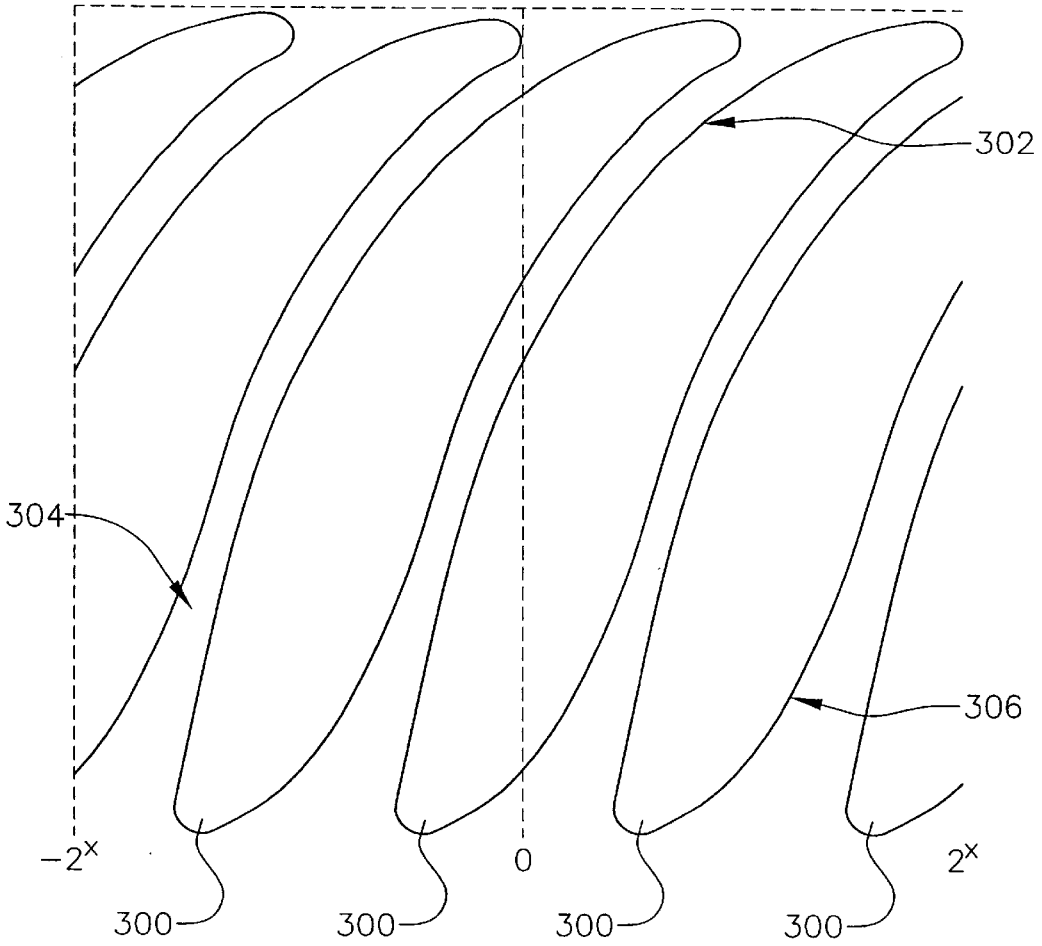
FIG. 3 is a graph illustrating the path of a helical thread on an intermediate shaft of the subsurface explorer of FIGS. 1*a*–1*b;*

With reference to FIG. 3, a graph illustrating the path of the helical thread 118 on the intermediate shaft 112 for multiple revolutions is shown. The path 300 has been unfolded for clarity. The helical thread 118 has non-uniform pitch, initially in a shape which applies approximately constant force on the hammer 110 via the conical rollers 120, and then changes to a shape which is approximately parabolic or eliptical, as shown at location 302, so that the hammer portion 110 accelerates uniformly down the bore of the inside body 102. The inital shape is sloped so that the braking of the intermediate shaft does not cause excessive forces on the conical rollers 120 and their associated bearings. The thread shape changes to continue approximately constant force on the conical rollers 120 even after the brake 140 has halted the rotation of the intermediate shaft 112. With reference back to FIG. 2*a*, initially, the small mass of the intermediate shaft 112 compared to the hammer portion 110 mass causes the intermediate shaft 112 to be accelerated upwards faster than the hammer portion 110 is accelerated downwards towards the nose cone 108, step 208. This is possible since the intermediate shaft 112 is splined onto the drive shaft 114 of the motor 116, and is free to slide up and down on the splined drive shaft 114. At the top of the intermediate shaft 112 is located a two-toothed ratchet male end 130. As the intermediate shaft 112 spins and rises under the braking action of the motor 116 and the helical thread 118, the male ratchet end 130 engages a mating female ratchet end 142 attached to the spring 126. A 2-count per rotation quadrature position encoder may be included on the motor 116 that allows the braking action to be initiated at the proper time so that the ratchet 140 teeth engage cleanly and almost fully without the possibility of partial engagement. When the ratchet 140 teeth engage, the intermediate shaft 112, the splined shaft 114, and the motor's 116 rotor all are despun to rest in one revolution or less by the spring 126 (e.g. 1000 Nt/cm spring constant) attached to the ratchet female 142. The spring 126 compresses and rotates under the inertial forces of the hammer mechanism and shaft 112 assemblies. However, with a compression typically of only a few cm, the intermediate shaft 112 is brought to rest, and the hammer portion 110 is rotating at its full original speed on the helical thread 118.

With reference back to FIG. 3, the helical thread 118 is shown unwound onto its projection onto a flat sheet, with multiple revolutions 300 shown for clarity. The conical roller 120 is captured within the cutouts which are the closed curves 300 in FIG. 3. Assuming in FIG. 3 the hammer portion 110 mass rotates so that it is moving from right to left, the roller 120 will follow the left edge of each closed loop 300, accelerating downward. On the return stroke, the motor 116 accelerates the hammer portion 110 and the roller 120 follows the right-hand part of the curve 300. The space between the right and left sides of the closed curve 300 is open, that is, it represents a cutout in the intermediate shaft 112 where, in principle, the conical roller 120 is captive anywhere within the curve 300.

At the location 304 on the curve 300, the area of transition to a more linear region for spring recoil and final rotation cancellation is shown. Location 306 illustrates a parabolic or elliptical recovery region for return of the hammer portion 100 to the top of the stroke after reversal and braking of the motor 116.

Figure 4A:
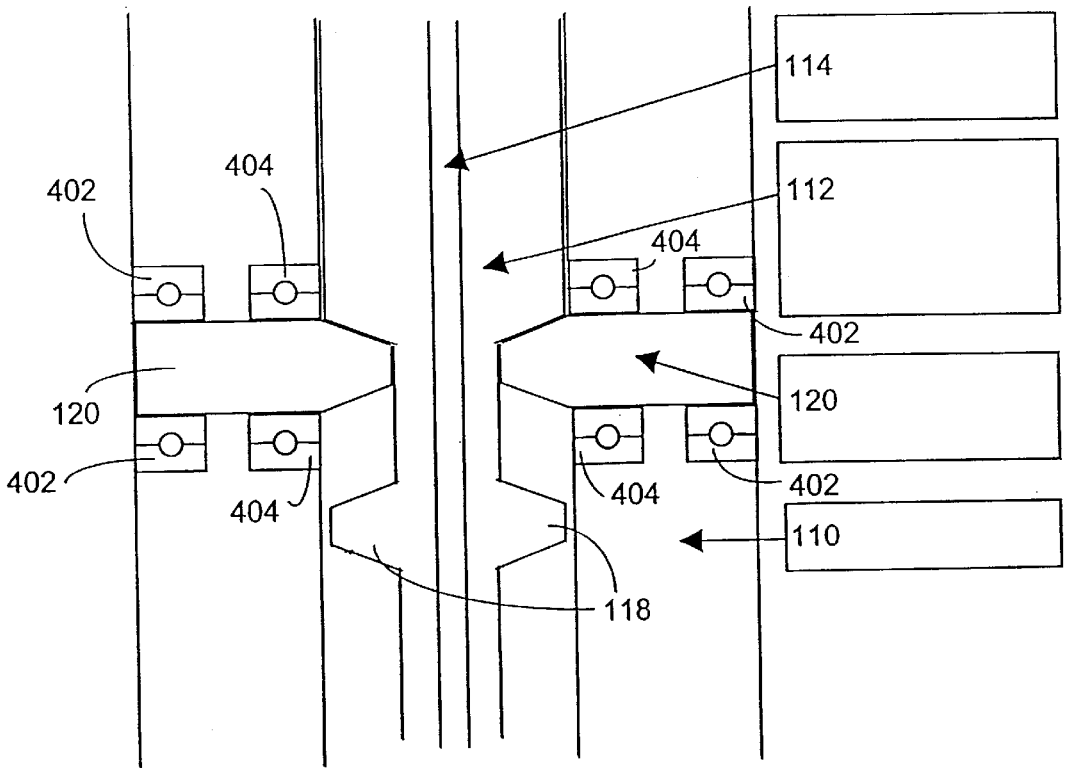
FIG. 4*a* is an enlarged cross-sectional view of the detail of the intermediate shaft, the hammer portion and the roller assembly of the embodiment of FIG. 1*a;*

With reference to FIG. 4*a*, detail of the intermediate shaft and hammer assembly are shown. The threads 118 on the intermediate shaft 112 are cut with sloped sides so as to form threads 118 and to engage conical rollers 112 without slipping. This follows the usual practice in conical roller 120 bearings where the apex of the cones intersect at the axis of rotation so that no slippage is necessary for the cones to roll smoothly on one another. The conical rollers 120 are supported by heavy bearings 402–404 embedded in the hammer portion 110, since the very large forces needed to accelerate the hammer portion 110 are imparted through the conical rollers 120. two rollers 120 and threads 118 are preferred so that balanced forces are applied to the hammer portion 110. More than two rollers 120 are possible, but the relatively large conical rollers 120 and the threads 118 on the intermediate shaft 112 to carry the large acceleration forces make two rollers 120 and threads 118 required more practical. This is driven by the fact that the intermediate shaft 112 is as small as possible given the loads, to allow the spinning hammer 110 to be as massive as possible.

The pitch of the thread 118 is preferably as fine as possible near the top of the non-uniform pitch thread 118, so that there are minimal sudden translational forces applied to the intermediate shaft 112 and hammer portion 110 when the splined drive shaft 114 begins to slow down, and especially when the ratchet 140 teeth engage and the large forces come into play. Thus, the tradeoff between the desire for a fine pitch and a heavy thread 118 create a preference for two rollers 120. The non-uniformity of the pitch of thread 118 also causes a preference for no more than two thread contact points along the length of the system, since only one of these contact points would, in general, make contact as the hammer portion 110 descends the non-uniform pitch of the thread 118. Similar needs for balanced forces combined with large loads lead to the desire that the ratchet 140 have only two teeth, although more could be used, and their shape can be square rather than triangular (to permit bidirectional operation) and can be actuated by a solenoid rather than by the braking action of motor 116.

When the hammer portion 110 gets to the bottom of the "parabolic" region of the thread 118 (actually, to get uniform vertical acceleration the shape would not be precisely parabolic, since it is decelerating horizontally as it accelerates vertically), almost all of its rotational energy has been converted to translational energy (i.e. the pitch of the thread 118 has changed by a factor of 3 or 4, so that about 90% or more of the rotational energy has been converted). The pitch of the thread 118 becomes uniform near the bottom end 104, so that the axial force drops to near zero and the spring 126 drives the ratchet 140 back down. As it does so, the spring 126 counterrotates the ratchet 140 and so removes most of the remainder of the rotational energy from the hammer portion 110, causing it to strike the nose piece 108 with almost no rotation. Small amounts of residual rotation are acceptable.

Upon impact, it is desirable to have a small amount of lubrication oil between the hammer portion 110 and the nose piece 108 at location 138 in FIG. 1. The tremendous force of the impact between the hammer portion 110 and the nose piece 108 would cause this oil to be extruded up between the splined shaft 114 and the intermediate shaft 112, between the intermediate shaft 112 and the hammer portion 110, between the hammer portion 112 and the inside of the body 102, and up additional vias in the system leading to all bearings and other moving parts. The hammer portion 110 nominally has ball bearings 134 at the top and near the bottom allowing it to spin freely inside the body 102. These bearings 134 may have some appropriate bushing or cylinder-ring material (e.g. bronze) pressed over the outer race to slide inside the honed cylindrical skin. In addition, there is a similar inner ball bearing 136 with bushing sliding and rotating over the intermediate shaft 112. The threads 118 cut in the intermediate shaft 112 end relatively high up on the shaft 112, so that the inner bearing 136 need not engage anything but smooth, honed shaft 112 material anywhere in its cycle of motion. By having the conical rollers 120 at the top of the hammer portion 110, the threaded region on the intermediate shaft 112 is kept away from the bearing region, and also the large impact forces of the hammer blow do not need to be transmitted past the bearings 136 to decelerate the bulk of the hammer material.

Additional vias in the system can allow gas compressed in front of the hammer portion 110 to escape into the thread 118 cutouts in the intermediate shaft 112 and ultimately vent behind the hammer portion 110 and thus not act as a shock absorber, reducing the effectiveness of the hammer portion 110. The entire percussive assembly can be sealed, and can be run at reduced pressure if desired to reduce this cushioning effect. Some residual gas is desirable if the motor 116 is of the brush type, and also to carry lubricant around the inside as percussion atomizes small droplets of oil into the gas. For very cold environments (e.g. Mars polar missions, comets) it is possible to use a gas in equilibrium with its own liquid to provide lubrication (e.g. carbon dioxide, nitrogen).

Figure 4B:
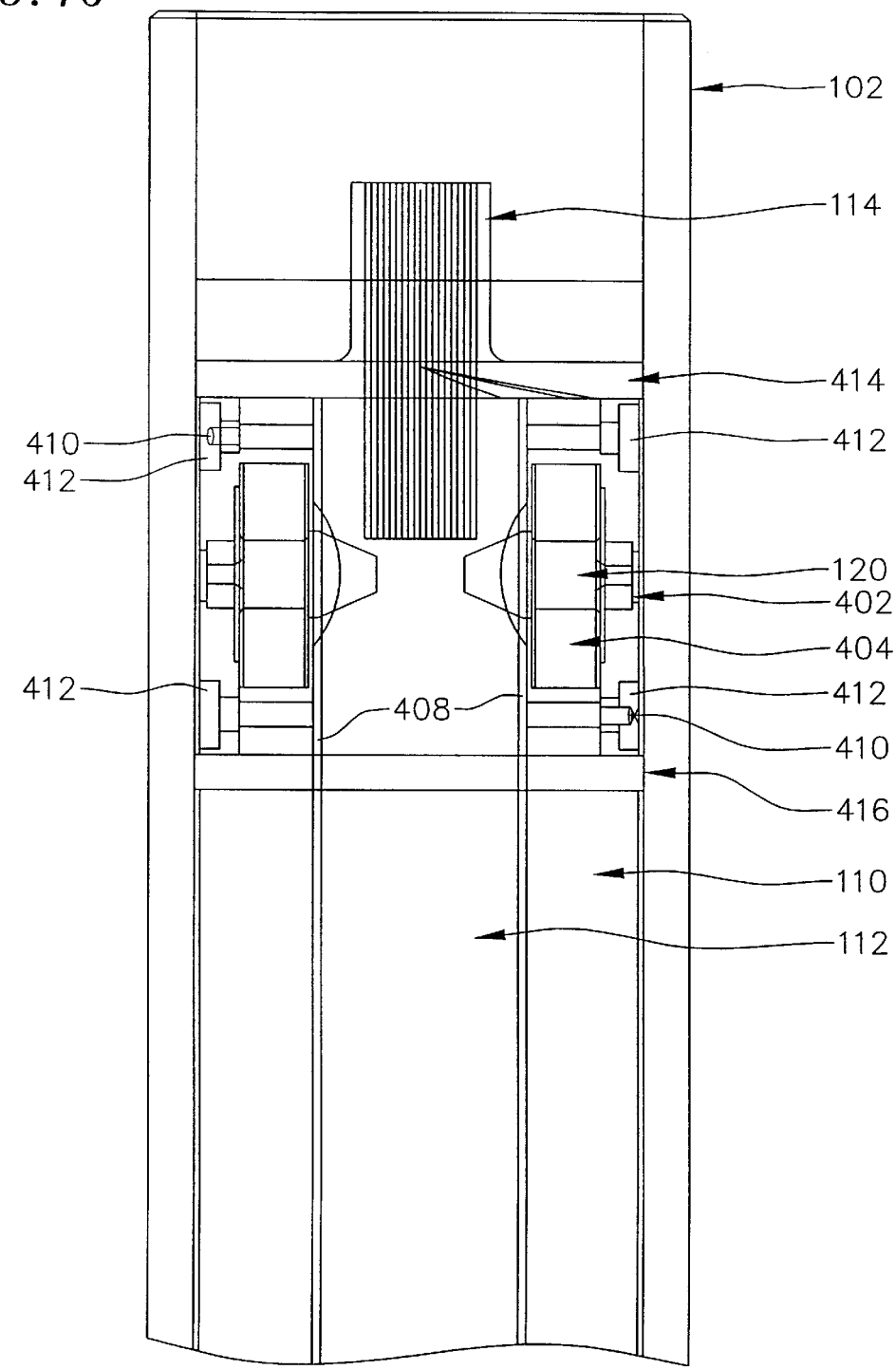
FIG. 4*b* an enlarged cross-sectional view of the detail of the intermediate shaft, the hammer portion and the roller assembly of the embodiment of FIG. 1*b;*

With reference to FIG. 4*b*, detail of the intermediate shaft 112 and hammer portion 110 and roller 120 assemblies according to an alternative embodiment to that shown in FIG. 4*a* is shown. The threads 118 on the intermediate shaft 112 are not shown in FIG. 4*b*. As with the detail shown in FIG. 4*a*, the system includes the hammer portion 110, intermediate shaft, 112, splined drive shaft 114, and conical rollers 120.

The assembly of FIG. 4*b* further includes a retainer plate 408 for retaining each conical roller 120 and bearing 402–404 assemblies. Four screw holes 412 on each retaining plate are further included to hold screws which hold the retainer plates 408 on the hammer portion 110. The retaining plates 408 further comprise shear holding pin holes 410 having pins for holding the retainer plates 408 in place.

Also shown in FIG. 4*b* are an upper flange 414 on the intermediate shaft for helping to secure the assembly against the body 102, and a land 416 on the hammer for centering the hammer portion 110 within the body 102. The hammer portion 110 is therefore not flush with the body 102, but is slightly inside the bore of the body 102, creating less friction and allowing gasses and oil to circulate.

Figure 2B:
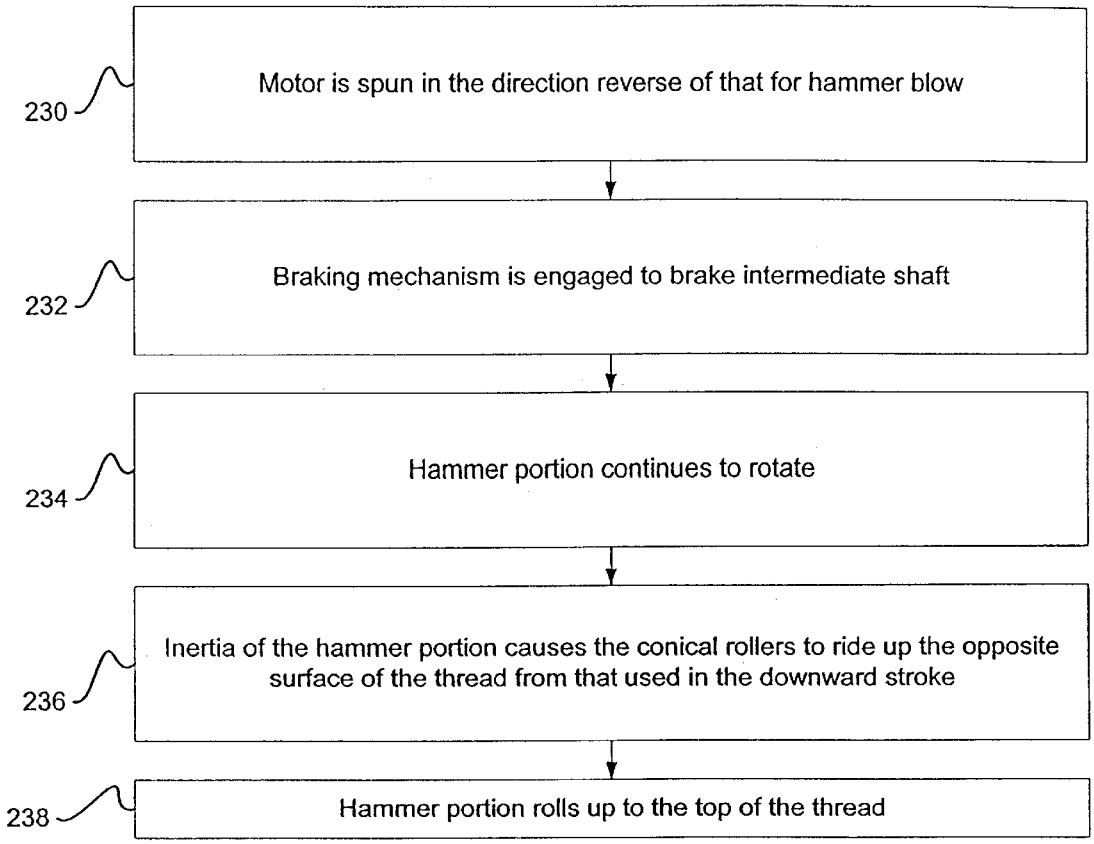
FIG. 2*b* is a flow diagram illustrating a method performed by the FIGS. 1*a*–1*b* to return the hammer portion of the present invention to the top of its stroke.

With reference to FIG. 2*b*, a flow diagram illustrating the method performed by the system of the present invention for returning the hammer portion 110 to the top of stroke is shown. The motor 116 is spun in the direction reverse of that for hammer portion 110 blow, step 230. The electric motor 116 is again braked by the braking mechanism 140, or by shorting, loading, or reverse-biasing the windings of the electric motor 116, step 232. The braking action again causes the hammer portion 110 to start to rotate with respect to the intermediate shaft 112, but in the direction opposite as with the downward stroke, step 234. The inertia of the hammer portion 110 causes the conical rollers 120 to ride up the opposite surface of the thread 118 from that used in the downward stroke, step 236. This surface is also conical so that the rollers 120 make good rolling contact. As seen at location 306 in FIG. 3, again there is a parabolic section to accelerate the hammer portion 110 smoothly upwards so that its inertia carries it up over the steepest part of the curve, against the force of gravity. The hammer portion 110 then rolls up to the top of the thread 118 even with a very weak motor 116, step 238. The inertial force on the intermediate shaft 112 causes it to tend to descend down the splined shaft 113: it is possible for it to engage a friction surface below on the face of the nose piece 108 or on the underside of the ratchet 150 wheel so that the braking of the intermediate shaft 112 is not dependent on the motor 116 characteristics. Thus there is no troublesome lower limit on the size or torque of the motor 116 needed to get the hammer portion 110 back to the starting position. Thus the motor 116 sizing is based on the available power budget, while the spinning hammer 110 energy is a function of how massive and fast the hammer portion 110 is to be spun. The only practical lower limit on the motor 116 size is based on the frictional losses in the bearings 134. If desired, there could be a small detent at the top of the thread 118 so that the rollers 120 could statically rest at the top of the thread 118 without requiring continuous rotational acceleration. The intermediate shaft 112 is retained at the bottom of the splined shaft 114 to prevent it from falling normally into rubbing contact with the nose piece 108 face. The motor 116, internal bearings or other bearings need to be sized to carry this static axial load.

Alternatively, if the motor 116 does have enough torque, then the intermediate shaft 112 may be spun in the forward direction without braking to cause the hammer portion 110 to rotate back up to the starting position.

Figure 5:
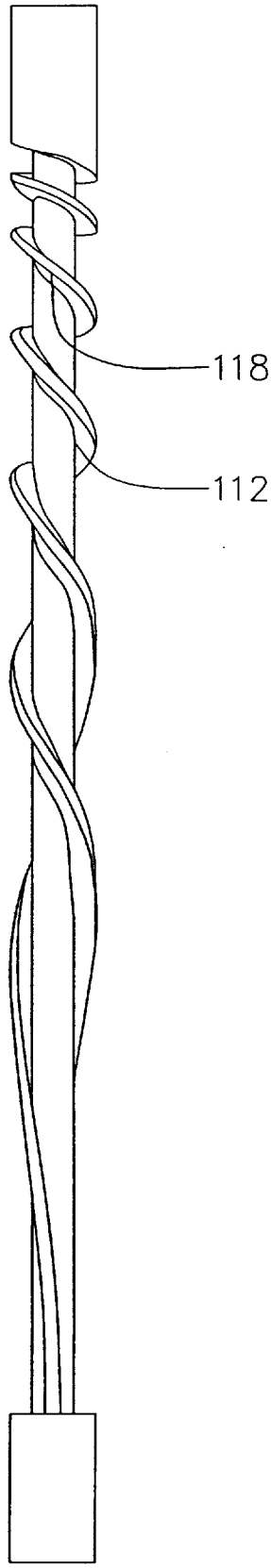
FIG. 5 is a front elevational view showing the intermediate shaft separated from the hammer mechanism and the vehicle assembly of the present invention.

With reference to FIG. 5, the intermediate shaft separated from the hammer mechanism and vehicle 100 assembly is shown. The thread 118 direction is reversed in FIG. 5 in order to accommodate an electric motor 116 which is made to spin in a forward direction opposite of that in FIG. 1*a*.

Figure 6:
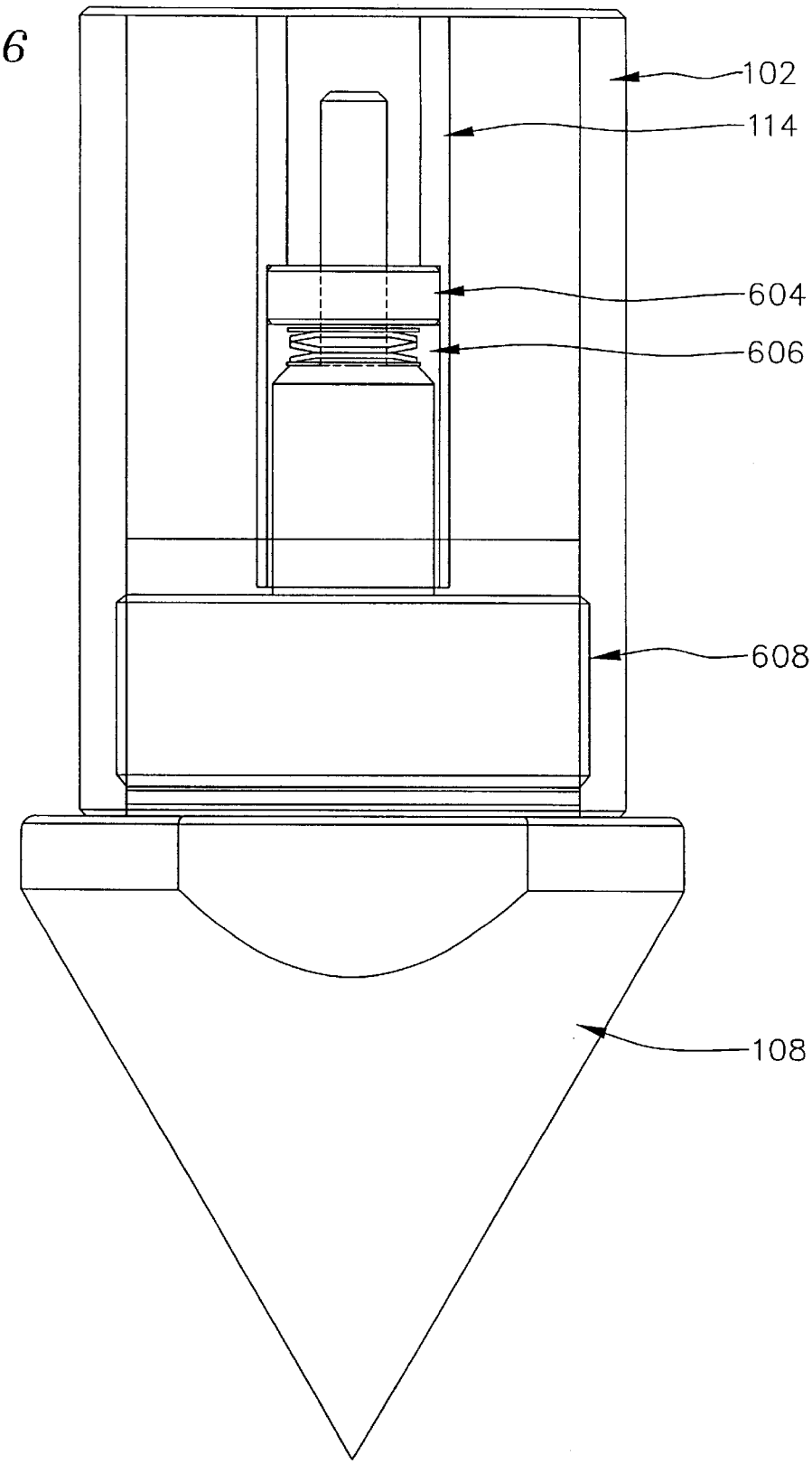
FIG. 6 is an enlarged cross-sectional view of the nose cone and the lower body assembly of the present invention.

With reference to FIG. 6, a diagram illustrating the detail of the nose cone 108 and lower body 102 assembly is shown. At the bottom of the intermediate shaft 112 is a lower support bearing 604 on which the intermediate shaft 112 spins. Below the lower support bearing 604 is a stack of shims and belleeville spring washers 606 which is used to lift the intermediate shaft 112 away from contact with the nose piece 108 and provides a measure of travel between the nose piece 108 and the intermediate shaft 112 to keep the lower support bearing 604 from receiving shock.

The nose piece 108 further comprises a threaded region 608 so that the nose piece 108 can be screwed within the body 102 in replaceable fashion.

An exemplary material from which the nose piece 108, body 102, and intermediate shaft 112 may be made from is VASCOMAX made by Teledyne, Inc. of Montebello, Calif. The military specification for VASCOMAX is MIL-S-46850D.

The efficiency of the hammer portion 110 is very high: the electric motor 116 can be made very efficient, especially since there is no severe requirement to miniaturize it. It can be wound to work directly off the high voltage supplied by the optimal tether 122, so that there is no loss due to voltage conversion. There is preferably no gearhead stepping down the output RPM of the motor 116, as would normally be expected in conversion of electricity to a large-force application. The hammer portion 110 used as a flywheel is well matched as a load to the electric motor 116, absorbing mechanical energy over the range of output speeds where electric motors produce maximum output efficiency. The hammer portion 110 has a conical roller mounted on ball (or roller) bearings 134, and converts the rotational kinetic energy into translational kinetic energy with relatively high efficiency. It is not inconceivable that the net efficiency in converting tether 122 power into spinning hammer 110 kinetic energy could approach 80%, where other competing approaches (e.g. high pressure gasses) would generally be between 20% and 30% efficient, and regenerative explosive mixtures would be less than that (15%), and solenoids less than that (5%, and also are unacceptably large and heavy to get the necessary kinetic energy). The ratchet 140 and spring 126 assembly serve primarily as a shock absorber and to prevent the need for excessive braking force by the motor 116 and it's bearings. The spring 126 for the ratchet 140 need not absorb more than a few percent of the energy of the hammer 110 in performing it's duties, and the efficiency with which it redelivers this energy is not very important. The spinning hammer mechanism is relatively economical from the standpoint of moving parts, and the bearing surfaces are relatively large and do not require extreme contact stresses. Provision for continuing lubrication is straightforward. There are no significant machining or assembly issues.

Figure 7A:
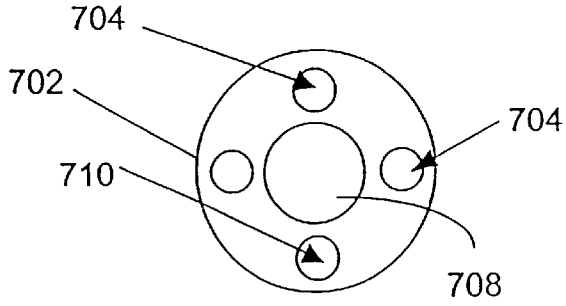
FIGS. 7*a*–7*b* respectively are a horizontal cross-sectional view and a vertical cross-sectional view of an alternative capillary tether of the present invention formed using a two-part material such as epoxy resin.
Figure 7B:
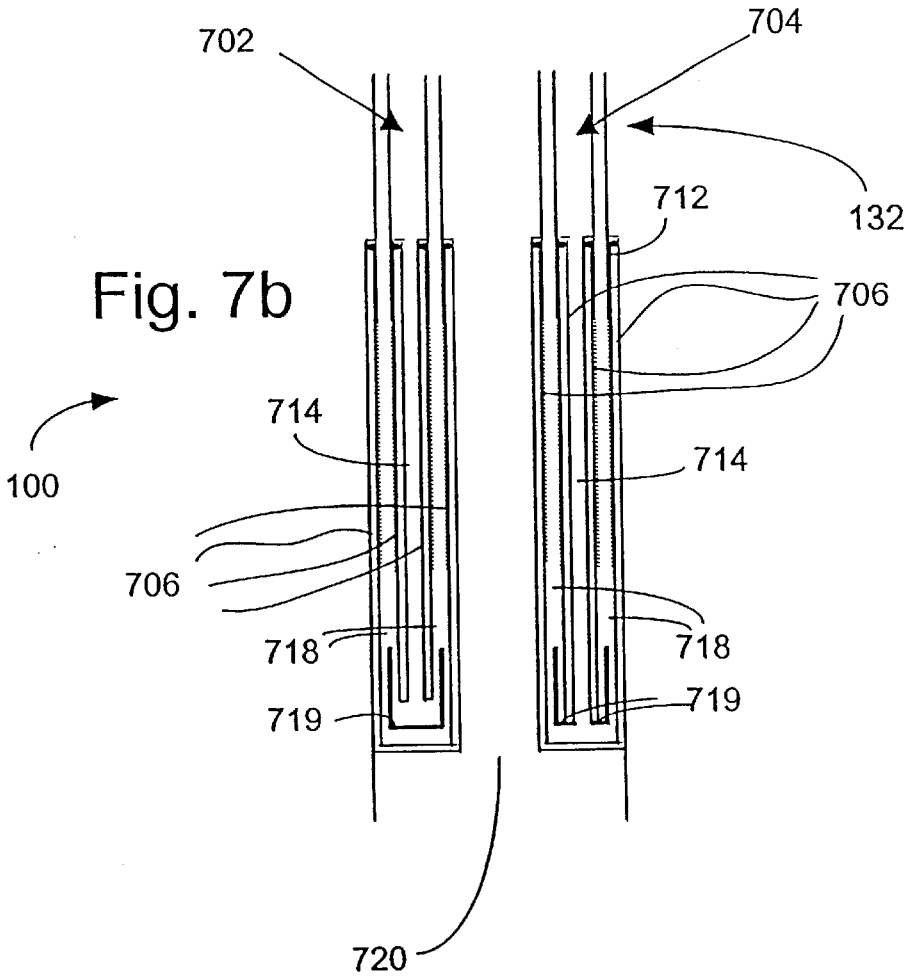

With reference to FIGS. 7*a*–7*b*, an alternative to the electrical and/or capillary tether 132 is to form a tether 132 in place using a two-part material such as epoxy resin. An assembly at the base of the tether 132 combines the two parts, the resin and the catalyst, to form the outer wall of a larger tube 708 than could be stored entirely within the vehicle 100. The relatively slow rate of advance of the subsurface vehicle 100 permits the epoxy to harden within the space of a mold 706, which forms the basic (presumably cylindrical) shape of the tube 708, plus possible additional cavities 710 such as channels molded into the walls of the tube 708. The primary channel in the center of the tube 708 carries a significant part of the cuttings fully from the excavation mechanism, eliminating the need to recompact the cuttings to the original density of the subsurface medium. In principle, it could also be large enough to carry sample cores back to the surface, or to bring down replacements for worn elements of the down-hole mechanism. The additional channels 702–704 molded into the wallcarries the epoxy in a first epoxy chamber 702, and the epoxy catalyst in a second epoxy chamber 704. The electrical power and signal wires and possibly drilling fluids or chemical fuels can be carried in additional channels 710 as well. The main tube 708 and each of the additional channels 710 may be molded by an appropriately shaped mold 706 material (such as stainless steel coated with a non-stick material like Teflon(™), and the motion of the vehicle 100 is slow enough that the material is set within the mold 706. As the rigid material emerges from the mold 706, it is sealed at the terminus of mold 706 with seals such as O-rings 712. This allows fluids to flow through the molded cavities 702–704, into mold channels 714, and then, in the case of the epoxy and the catalyst, to a mixing chamber 718 at the back of the mold. The two parts are extruded together by baffles 719 in thin sections so that the diffusion of the two parts together suffice for mixing, together with whatever turbulence might be present or induced in the flow by appropriate structures, active or passive. In the case of other fluids or wires or other utility lines, these can exit the front of the mold assembly 720.

Figure 8:
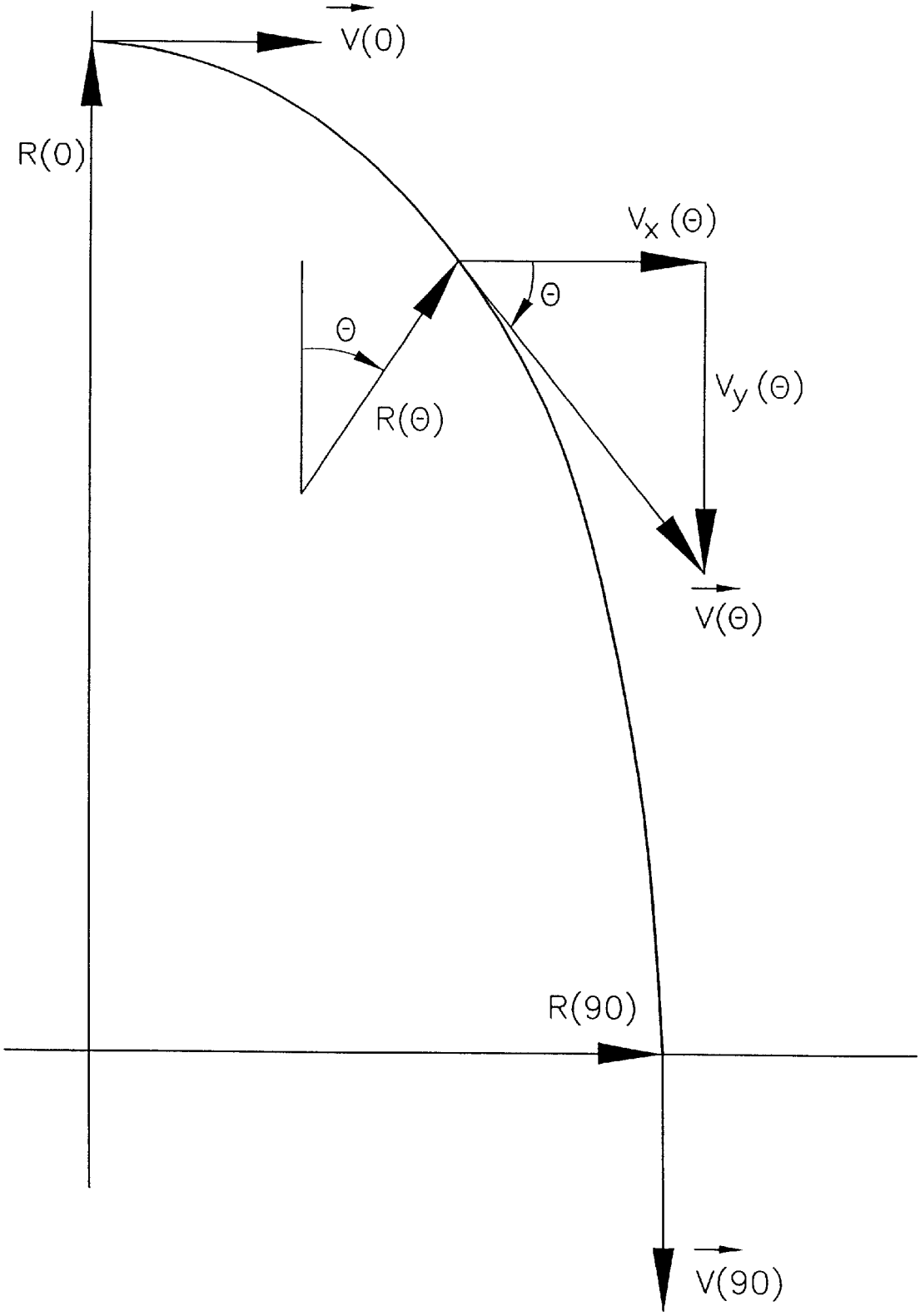
FIG. 8 is a graph illustrating a preferred variance in velocity of the conical rollers of the vehicle assembly of the present invention during operation.

With reference to FIG. 8, a graph illustrating a preferred variance in velocity of the conical rollers 120 is shown. Due to the geometry of the conical rollers 120, intermediate shaft 112, and hammer portion 110, with the following assumptions:

Initial slope of thread 118 is 0° (horizontal)

Final slope of thread 118 is 90° (vertical)

Intermediate shaft 112 stops instantly

Initial energy in hammer portion 110 (entirely rotational= $\frac{1}{2}Iw_0^2$) is completely converted to translational energy at end of thread 118: $E=\frac{1}{2}Mv_f^z$ no friction losses $v(\theta)$=velocity of conical roller 120 on thread 118

$v_x(\theta)=v(\theta)\cos\theta$=component of velocity due to hammer portion 110 rotation$-w(\theta)\cdot\sqrt{1}$ $v_y(\theta)=v(\theta)\sin\theta$=component of velocity due to downward (linear) motion of hammer portion 110, the non uniform thread 118 should preferably cause the velocity of the conical rollers 120 to vary according to the formula:

$$v(\theta)=v_f(\sin^2\theta+(r1/r0)^2\cos^2\theta)^{1/2}$$

as the conical roller 120 rolls from the top of the curve ($\theta$=0°) to the bottom ($\theta$–90°), wherein $\theta$=slope of thread, or curve, from horizontal $V_f$=final velocity=$v(90)=w_0r_0$ $w_0$=initial angular velocity of spinning hammer $r_0$ = "radius of gyration" of spinning hammer $= \sqrt{I/M}$ – definition of $r_0$ $I$ = rotational inertia of hammer around spin axis -continued $M$ = mass of hammer $r_1$ = average radius from conical roller line contact to Hammer's axis of rotation For constant force between conical rollers and intermediate shaft thread:

$v(\theta)^2/R(\theta)$=constant from $a=v^2/r$, acceleration of an object moving with velocity, v, along a curved path, r=radius of curvature $R(\theta)$=radius of curvature of flattened Intermediate Shaft thread; a function of the slope at any point along the curve $$v(\theta)^2/R(\theta)=K\rightarrow R(\theta)=(1/K)v(\theta)^2=(1/K)v_f^2(\sin^2\theta+(r_1/r_0)^2\cos^2\theta)$$

$$K=v(0)^2/R(0)=V(90)^2/R(90)$$

R(0) is the initial radius of curve

R(90) is the final radius of curve

It should be noted that:

$$v(0)=w_0r_1$$

$$v(90)=v_f=w_0r_0$$

$$(1/K)v_f^2=(R(0)/v(0)^2)(v_f^2)=R(0)/(w_0r_1)^2(w_0r_0)^2=R(0)(r_0r_1)^2$$

$$R(\theta)=R(0)(r_0/r_1)^2(\sin^2\theta+(r_1/r_0)^2\cos^2\theta).$$

Alternative embodiments which employ the same concept include changing the number of threads 118 on the intermediate shaft, using somewhat different geometries in place of the conical rollers 120, changing the number or shape of teeth on the brake ratchet 140 assembly, actuating brake 140 with a solenoid, etc. The underlying concept is to spin the hammer 110 as a flywheel to surface speeds greater than the needed hammer velocity, and then to use a non-uniform pitch on a thread 118 to convert the rotational motion to linear motion. The use of the brake ratchet 140 assembly (perhaps with solenoid actuation) is the illustrated embodiment, but other means exist, such as friction clutches or hydraulic mechanisms, to perform its function.

It will thus be seen that changes may be made in carrying out the above system and method and in the construction set forth without departing from the spirit and scope of the invention, it is intended that any and all matter contained in the above description and shown in the accompanying drawings shall be interpreted as illustrative and not in a limiting sense.

What is claimed is:

1. A vehicle for exploring beneath the surface of a planetary terrain made of composition material, comprising:

a body having a front end and a rear end;

a nose piece fixed to the front end for imparting force to the terrain so that the vehicle penetrates the composition material in front of the nose piece and leaves the composition material deposited behind the rear end; and a tether system for providing power and communication to the vehicle and returning subsurface samples, the tether system comprising:

two or more electrical conductors leading from a point of origin to the vehicle;

one or more capillary tubes for moving fluids from the point of origin to the vehicle; and a spool for spooling the electrical conductors and the capillary tubes from within the vehicle and packing the electrical conductors and the capillary into the composition material deposited behind the rear end.

2. A hammer apparatus for imparting force to a nose piece for the purpose of fracturing composition material in front of the nose piece, comprising:

an intermediate shaft adapted for rotation relative to the nose piece;

a hammer portion adapted for rotation relative to the nose piece and of a shape receivable over the intermediate shaft in sliding engagement therewith;

a braking structure connected to the intermediate shaft; and wherein the braking structure is configured to brake the rotation of the intermediate shaft and convert the rotation of the hammer portion into translational motion.

3. The hammer apparatus of claim 2, wherein the hammer portion is substantially annular in shape and is receivable over the intermediate shaft in sliding engagement therewith.

4. The hammer apparatus of claim 2, wherein the intermediate shaft has at least one outwardly directed thread of variable pitch extending some distance along the length of the intermediate shaft.

5. The hammer apparatus of claim 4, wherein:

the hammer portion further comprises at least one roller engaging the thread in a guiding relationship for guiding the hammer portion;

the intermediate shaft has a top end and a bottom end; and the thread has a relatively low pitch at the top end of the intermediate shaft and a relatively high pitch at the bottom end of the intermediate shaft, whereby the hammer is accelerated downwardly when the rotation speed of the intermediate shaft is reduced.

6. The hammer apparatus of claim 5, wherein an electric motor is configured to rotate the intermediate shaft, and the hammer portion in an opposite direction of rotation to accelerate the hammer portion upwardly along the intermediate shaft, causing the roller to traverse the thread from the bottom end of the intermediate shaft to top end of the intermediate shaft.

7. The hammer apparatus of claim 2, wherein:

the hammer portion, intermediate shaft and braking structure are housed within a body having a front end and a rear end;

said nose piece is fixed to the front end of the body;

the hammer portion imparts a percussive force on said nose piece; and said nose piece and body are configured such that the percussive force on the nose piece causes composition material in front of the nose piece to be deposited behind the rear end of the body.

8. The hammer apparatus of claim 7, wherein the body is elongated between the front end and the rear end.

9. The hammer apparatus of claim 8, wherein said nose piece and body are sealed against intrusion of composition material.

10. The hammer apparatus of claim 9, wherein the hammer portion, intermediate shaft and braking mechanism are spring mounted within the body.

11. The hammer apparatus of claim 9, wherein said nose piece and the body are configured such that the cross-sectional area of the nose piece exceeds that of the body, thereby reducing friction between the composition material and the side walls of the body during operation.

12. A system for converting rotational kinetic energy into translational kinetic energy comprising:

an intermediate shaft capable of rotation;

a thread of non-uniform pitch having a start point and an end point, the thread having a low pitch adjacent the start point and a high pitch adjacent the end point;

an annular hammer potion having a hollow center potion receiving the intermediate shaft; and at least one conical roller for movement therealong carried by the hammer portion and engaging the thread such that when the intermediate shaft and hammer potion are rotated together and the rotation speed of the intermediate shaft is suddenly reduced the conical roller follows the thread thereby converting the kinetic energy of the hammer portion from rotational energy into translational energy as the conical roller moves from the low pitch portion of the thread to the high pitch portion of the thread.

* * * * *